US008684358B2

(12) United States Patent
Stewart

(10) Patent No.: US 8,684,358 B2
(45) Date of Patent: Apr. 1, 2014

(54) GAMING SYSTEM AND A REEL ASSEMBLY FOR A GAMING SYSTEM

(75) Inventor: Scott Monroe Stewart, Las Vegas, NV (US)

(73) Assignee: Aristocrat Technologies Australia Pty Limited (AU)

( * ) Notice: Subject to any disclaimer, the term of this patent is extended or adjusted under 35 U.S.C. 154(b) by 0 days.

(21) Appl. No.: 13/367,109

(22) Filed: Feb. 6, 2012

(65) Prior Publication Data

US 2012/0200032 A1 Aug. 9, 2012

Related U.S. Application Data

(60) Provisional application No. 61/439,594, filed on Feb. 4, 2011.

(51) Int. Cl.
*A63B 71/00* (2006.01)

(52) U.S. Cl.
USPC ..... 273/138.1

(58) Field of Classification Search
None
See application file for complete search history.

(56) References Cited

U.S. PATENT DOCUMENTS

| | | | | |
|---|---|---|---|---|
| 3,642,287 | A * | 2/1972 | Tally et al. | 273/143 R |
| 4,206,920 | A * | 6/1980 | Weatherford et al. | 463/18 |
| 4,306,768 | A * | 12/1981 | Egging | 359/630 |
| 4,371,870 | A * | 2/1983 | Biferno | 345/4 |
| 4,454,670 | A * | 6/1984 | Bachmann et al. | 40/584 |
| 4,518,225 | A * | 5/1985 | Fredrickson et al. | 349/68 |
| 4,718,672 | A * | 1/1988 | Okada | 463/20 |
| 4,756,414 | A * | 7/1988 | Mott | 206/720 |
| 5,984,782 | A * | 11/1999 | Inoue | 463/20 |
| 6,086,066 | A * | 7/2000 | Takeuchi et al. | 273/143 R |
| 6,162,121 | A * | 12/2000 | Morro et al. | 463/16 |
| 6,554,703 | B1 * | 4/2003 | Bussick et al. | 463/20 |
| 6,802,507 | B2 * | 10/2004 | Inoue | 273/143 R |
| 8,096,867 | B2 * | 1/2012 | Okada | 463/20 |
| 8,235,782 | B2 * | 8/2012 | Walker et al. | 463/13 |
| 8,337,286 | B2 * | 12/2012 | Imura et al. | 463/16 |

* cited by examiner

*Primary Examiner* — Kurt Fernstrom
*Assistant Examiner* — Dolores Collins
(74) *Attorney, Agent, or Firm* — McAndrews, Held & Malloy, Ltd.

(57) ABSTRACT

A reel assembly for a gaming system is disclosed. The reel assembly comprises a spinnable reel drum having a ring member, at least one support strut extending from the ring member and serving to mount the ring member such that the ring member is spinnable during use, and a reel strip. The ring member and the reel strip are arranged such that at least part of the reel strip is engageable with the ring member so as to retain the reel strip relative to the ring member during spinning of the reel drum.

9 Claims, 4 Drawing Sheets

GAMING SYSTEM AND A REEL ASSEMBLY FOR A GAMING SYSTEM

RELATED APPLICATIONS

This application claims priority to U.S. Provisional Application No. 61/439,594, having a filing date of Feb. 4, 2011, entitled "A Gaming System and Reel Assembly for a Gaming System," which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to a gaming system and to a reel assembly for a gaming system.

It is known to provide a gaming system which comprises a plurality of symbol bearing reels, and a game controller arranged to control the reels so as to randomly display several symbols from a predetermined set of symbols, and to determine a game outcome such as a game win based on the displayed symbols.

Such symbol bearing reels may be virtual reels represented on a display device or may be physical reels.

A known physical reel assembly 10 is shown in FIGS. 1 and 2. The reel assembly 10 includes a reel drum 12 rotatably mounted relative to a support member 14, and the reel drum 12 comprises an inner ring 16 and an outer ring 18 connected together by several ribs 20. A reel strip 22 extends over the ribs 20 so as to define a reel surface on which symbols 28 are disposed. The reel drum 12 also comprises struts 24 which serve to fix the reel drum 12 to a motor 26 mounted on the support member 14.

In some such reel assemblies 10, a lighting device (not shown) is mounted inside the reel assembly 10 for illuminating one or more of the symbols 28 during implementation of a game.

However, with such a reel assembly which includes a lighting device, for at least some of the symbols which are disposed on the reel strip 22 adjacent a connecting rib 20, when the symbol is illuminated using the lighting device, it is sometimes possible for the connecting rib 20 to be seen through the reel strip 22. While this may be minimized by ensuring that the connecting ribs are always disposed between adjacent symbols on the reel strip, this imposes undesirable restrictions on the placement of symbols on the reel strip 22.

BRIEF SUMMARY OF THE INVENTION

In accordance with a first aspect of the present invention, there is provided a reel assembly for a gaming system, the reel assembly comprising:

a spinnable reel drum comprising:

a ring member;

at least one support strut extending from the ring member and serving to mount the ring member such that the ring member is spinnable during use; and a reel strip;

the ring member and the reel strip being arranged such that at least part of the reel strip is engageable with the ring member so as to retain the reel strip relative to the ring member during spinning of the reel drum.

In one embodiment, the reel assembly comprises a motor operatively associated with the at least one support strut and arranged to controllably cause the at least one support strut and thereby the reel drum to spin.

In one embodiment, the reel assembly comprises a support member, the motor being mounted on the support member such that the reel drum spins relative to the support member during use.

In one embodiment, the ring member comprises a ring recess for receiving the reel strip and thereby engaging with the reel strip.

In one embodiment, the ring recess comprises an annular ring recess.

In one embodiment, the ring member comprises a plurality of ring recesses disposed in a generally annular configuration and the reel strip comprises a plurality of reel strip tabs, each reel strip tab being receivable in and engageable with a ring recess.

In one embodiment, the reel drum comprises an inner ring member and an outer ring member, the inner ring member being provided with at least one first ring recess for receiving and thereby engaging with the reel strip.

In one embodiment, the outer ring member comprises at least one second ring recess for receiving and thereby engaging with the reel strip.

The reel strip and the or each ring recess may be arranged so as to form an interference fit.

In addition or alternatively, the reel drum may comprise adhesive between the reel strip and the or each ring recess for securing the reel strip relative a ring member.

In one embodiment, the reel strip and the or each ring member comprises first and second complementary fixing devices respectively arranged to facilitate fixing of the reel strip relative to the or each ring member. The first fixing means may be disposed on a ring member and may comprise a tab having a first fixing aperture, and the second fixing means may disposed on the reel strips and may comprise a second fixing aperture, the first and second fixing apertures being alignable with each other when the reel strip is engaged with the ring member so as to receive a fixing device such as a rivet or bolt.

In accordance with a second aspect of the present invention, there is provided a gaming system comprising a reel assembly according to the first aspect f the present invention.

BRIEF DESCRIPTION OF SEVERAL VIEWS OF THE DRAWINGS

The present invention will now be described, by way of example only, with reference to the accompanying drawings, in which.

DETAILED DESCRIPTION OF THE INVENTION

Figure 1:
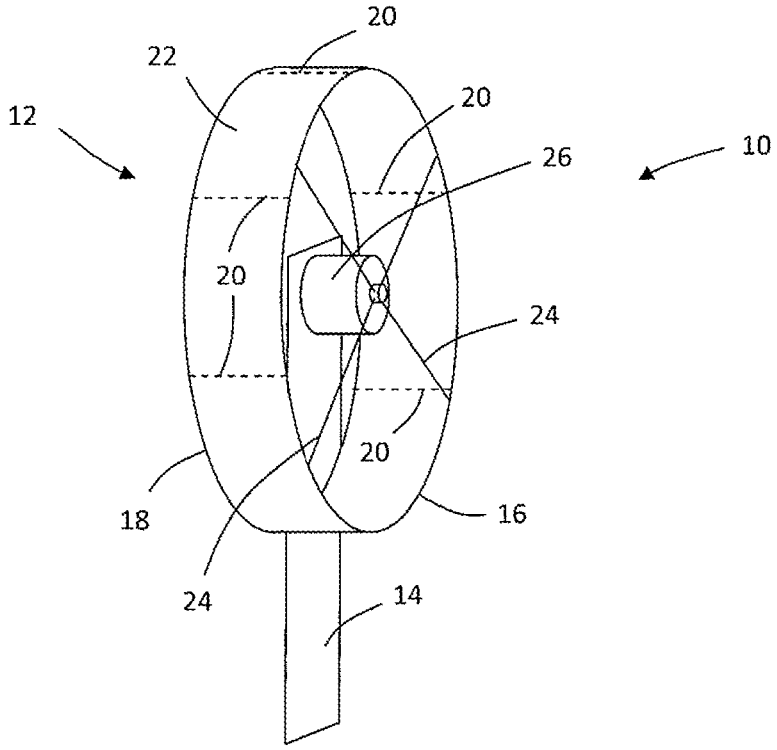
FIG. 1 is a diagrammatic perspective view of a prior art reel assembly.
Figure 2:
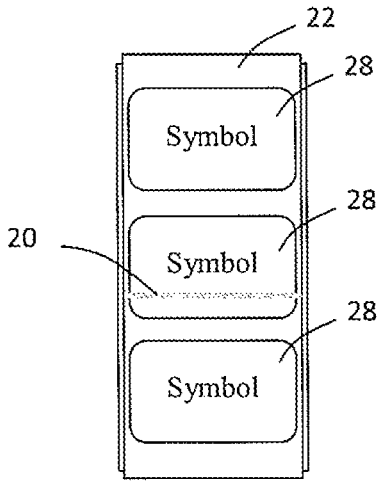
FIG. 2 is a diagrammatic front view of the prior art reel assembly shown in FIG. 1.
Figure 3:
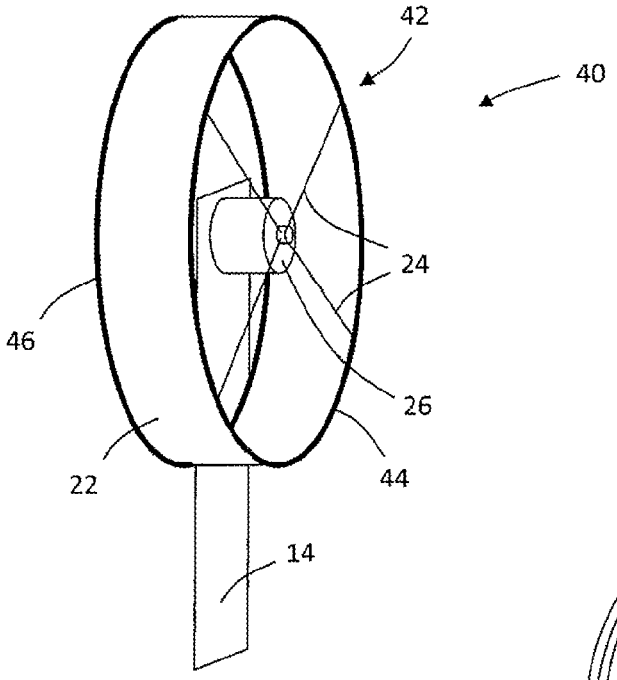
FIG. 3 is a diagrammatic perspective view of a reel assembly in accordance with an embodiment of the present invention.
Figure 4:
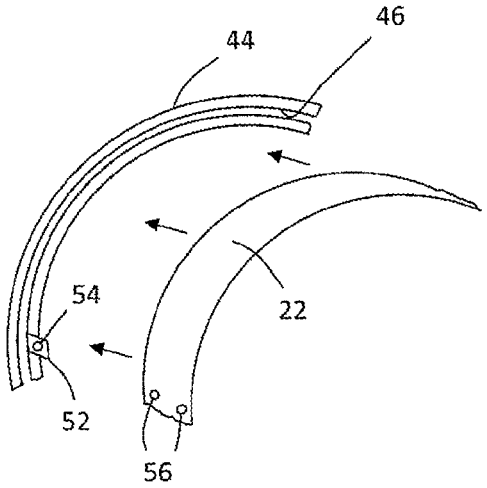
FIG. 4 is a diagrammatic view of part of an inner ring of the reel assembly shown in FIG. 3 and showing engagement of the inner ring with a reel strip.
Figure 5:
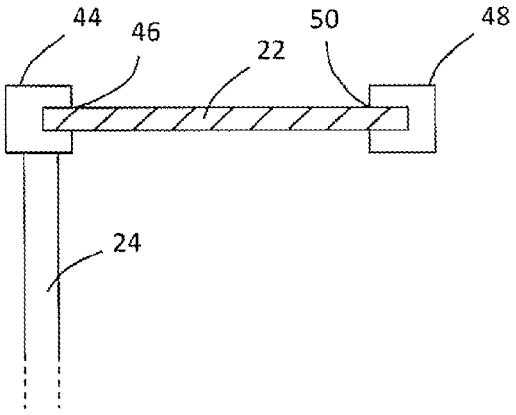
FIG. 5 is a diagrammatic cross sectional view of part of the reel assembly shown in FIG. 3.

Referring to FIGS. 3 to 5 of the drawings, there is shown a reel assembly for a gaming system arranged to implement a probabilistic game, in this example of the type wherein a plurality of spinnable symbol bearing reels are provided, and several symbols from a set of symbols associated with the reels are randomly selected and displayed and a game outcome determined on the basis of the displayed symbols. With some such probabilistic games, the set of symbols include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display in the same win line, scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions. The available win lines may be fixed, may be determined on the basis of the bet placed, or may be selectable by a player.

One example of selecting symbols is for a symbol selector to select symbols for display by selecting a reel stopping position. For this purpose, it is known to use a probability table stored in memory so as to vary the odds of a particular stop position being selected. Other techniques can be used to control the odds of particular outcomes occurring to thereby control the return to player of the game.

FIGS. 3 to 5 show a reel assembly 40 according to an embodiment of the invention. Like and similar features are indicated with like reference numerals.

The reel assembly 40 includes a reel drum 42 rotatably mounted relative to a support member 14. The reel drum 42 comprises an inner ring 44 arranged so as to define an annular shaped housing having an annular inner ring recess 46 for receiving a reel strip 22. The width of the inner ring recess 46 is sized such that the inner ring recess 46 and the reel strip 22 form an interference fit wherein the thickness of the reel strip 22 is slightly larger than the width of the inner ring recess 46. The reel drum 42 also comprises an outer ring 48 arranged so as to define an annular shaped housing having an annular outer ring recess 50 for receiving the reel strip 22. As with the inner ring recess 46, the width of the outer ring recess 50 is sized such that the outer ring recess 50 and the reel strip 22 form an interference fit wherein the thickness of the reel strip 22 is slightly larger than the width of the outer ring recess 50.

The reel drum 42 also comprises struts 24 which serve to fix the reel drum 42 to a motor 26 mounted on the support member 14.

It will be understood that by providing annular recesses 46, 50 in the inner and outer rings 44, 48 for receiving the reel strip 22, the inner ring 44, the outer ring 48 and the reel strip can be connected together without the use of connecting struts extending between inner and outer rings of the drum 42.

While the present embodiment includes a single annular recess provided in each of the inner and outer rings 44, 48, it will be understood that other arrangements are possible. For example, the inner and/or ring member may comprise a plurality of recesses disposed in a generally annular configuration and the reel strip may comprise a plurality of reel strip tabs, each reel strip tab being receivable in and engageable with a recess.

It will also be understood that instead of providing an interference type fit between the reel strip 22 and the inner and outer rings 44, 48, any other arrangement may be provided for joining the reel strip 22 to the inner and outer rings 44, 48. For example, adhesive may be used, or complementary fixing devices may be provided on the reel strip 22 and on the inner and outer rings 44, 48. In one example, as shown in FIG. 4, a fixing tab 52 having a first fixing aperture 54 may be provided on each of the inner and outer rings 44, 48, and second fixing apertures 56 provided on the reel strip 22. When the reel strip 22 is received in an annular recess 46, 50, the reel strip 22 is alignable with the or each fixing tab 52 such that the first fixing aperture(s) 54 align with corresponding second fixing aperture(s) 56 on the reel strip 22. A suitable fixing device such as a rivet or bolt may then be passed through aligned first and second fixing apertures so as to fix the respective ring to the reel strip 22.

The reel assembly 42 may be used in any suitable spinning reel type probabilistic game wherein physical reels are provided.

Figure 6:
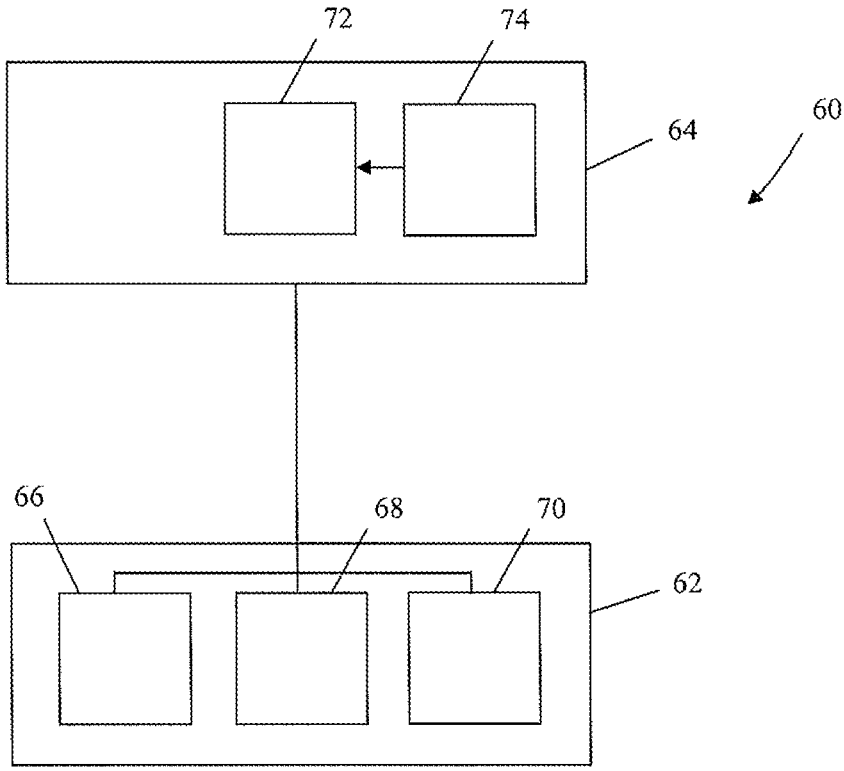
FIG. 6 is a schematic block diagram of components of a gaming system in accordance with an embodiment of the present invention.

Referring to FIG. 6, a schematic diagram of components of an example gaming system 60 incorporating physical spinning reels is shown. The components comprise a player interface 62 and a game controller 64. The player interface 62 is arranged to enable interaction between a player and the gaming system and for this purpose includes input/output components required for the player to enter instructions and play the game.

Components of the player interface 62 may vary but will typically include a credit mechanism 66 to enable a player to input credits and receive payouts, one or more game play areas 68 including a plurality of spinnable symbol bearing physical reels and which may comprise a touch screen, and a game play mechanism 70 arranged to enable a player to input game playing instructions.

The game controller 64 is in data communication with the player interface 62 and typically includes a processor 72 arranged to process game play instructions and output game player outcomes to the player interface 62. Typically, the game play instructions are stored as program code in a memory 74 that can also be hardwired. It will be understood that in this specification the term "processor" is used to refer generically to any device that can process game play instructions and may include a microprocessor, microcontroller, programmable logic device or any computational device such as a personal computer or a server.

The gaming system 60 can take a number of different forms.

In a first form, a stand alone gaming machine is provided wherein all or most components required for implementing the game, including the spinnable symbol bearing reels, are present in a player operable gaming machine.

In a second form, a distributed architecture is provided wherein some of the components required for implementing the game, including the spinnable symbol bearing reels, are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to play audible and/or display visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 7:
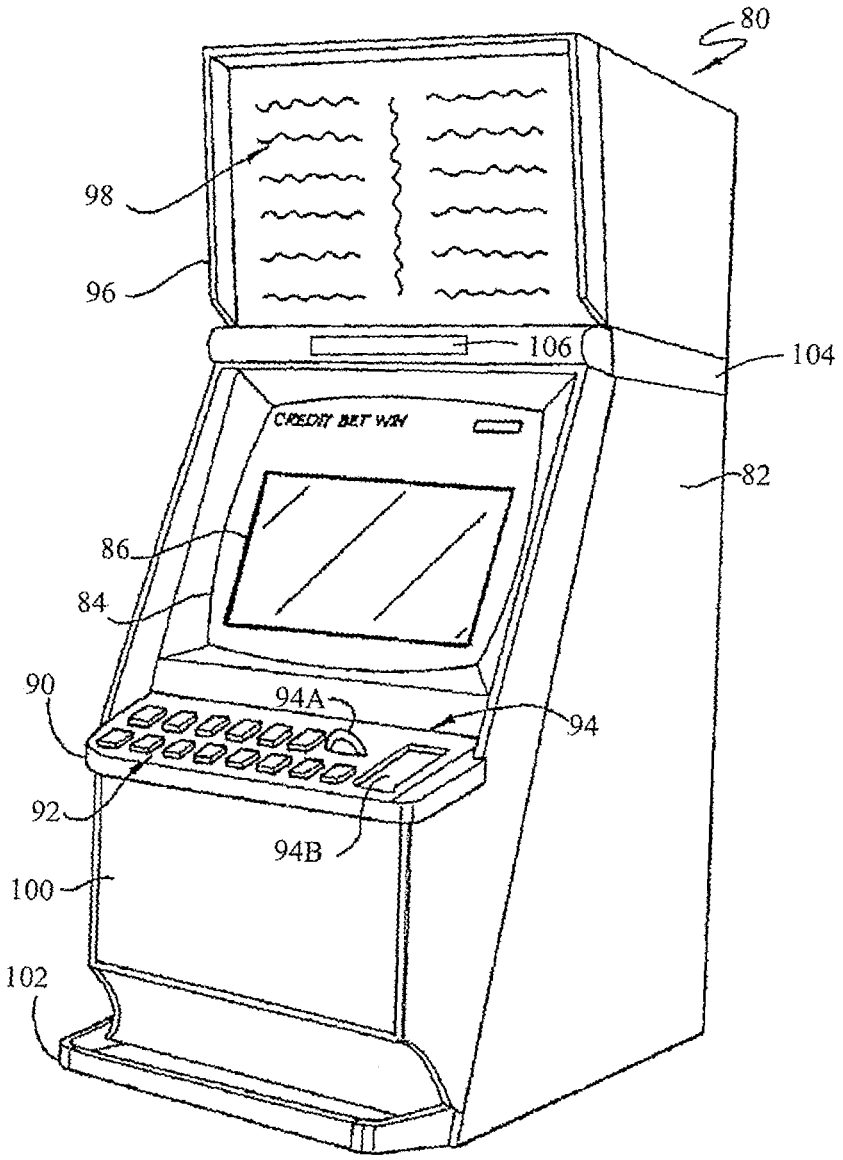
FIG. 7 is a diagrammatic representation of a gaming system in accordance with an embodiment of the present invention with the gaming system implemented in the form of a stand alone gaming machine.

A gaming system in the form of a stand alone gaming machine 80 is illustrated in FIG. 7. The gaming machine 80 includes a console 82 having game play area 84 provided with a window 86 through which a plurality of symbol bearing spinnable physical reels are visible. A mid-trim 90 of the gaming machine 80 houses a bank of buttons 92 for enabling a player to interact with the gaming machine, in particular during gameplay. The mid-trim 90 also houses a credit input mechanism 94 which in this example includes a coin input chute 94A and a bill collector 94B. Other credit input mechanisms may also be employed, for example, a card reader for reading a smart card, debit card or credit card.

A top box 96 may carry artwork 98, including for example pay tables and details of bonus awards and other information or images relating to the game. Further artwork and/or information may be provided on a front panel 100 of the console 82. A coin tray 102 is mounted beneath the front panel 100 for dispensing cash payouts from the gaming machine 80.

The top box 96 may include a display, for example a video display unit for displaying information relevant to the game implemented by the gaming machine 80.

A player marketing module (PMM) 104 having a display 106 is connected to the gaming machine 80. The main purpose of the PMM 104 is to allow the player to interact with a player loyalty system. The PMM has a magnetic card reader for the purpose of reading a player tracking device, for example as part of a loyalty program. However other reading devices may be employed and the player tracking device may be in the form of a card, flash drive or any other portable storage medium capable of being read by the reading device. In this example, the PMM 104 is a Sentinel III device produced by Aristocrat Technologies Pty Ltd.

In the claims of this application and in the description of the invention, except where the context requires otherwise due to express language or necessary implication, the words "comprise" or variations such as "comprises" or "comprising" are used in an inclusive sense, i.e. to specify the presence of the stated features but not to preclude the presence or addition of further features in various embodiments of the invention. Modifications and variations as would be apparent to a skilled addressee are deemed to be within the scope of the present invention.

The invention claimed is:

1. A reel assembly for a gaming system, the reel assembly comprising:

a spinnable reel drum comprising:

(1) a ring member comprising at least one fixing tab, said fixing tab having a first aperture;

(2) at least one support strut extending from the ring member and serving to mount the ring member such that the ring member is spinnable during use; and (3) a reel strip comprising at least one second aperture;

wherein the ring member and the reel strip are arranged such that said second aperture of the reel strip aligns with said first aperture of the ring member so as to (i) align the reel strip relative to the ring member and (ii) provide a means for fixing the reel strip to the ring member during spinning of the reel drum.

2. A reel assembly as claimed in claim 1, and further comprising a motor being operatively associated with the at least one support strut and configured to controllably cause the at least one support strut and thereby the reel drum to spin.

3. A reel assembly as claimed in claim 2, and further comprising a support member, the motor being mounted on the support member such that the reel drum is spinnable relative to the support member during use.

4. A reel assembly as claimed in claim 1, wherein the ring member comprises a ring recess for receiving the reel strip and being of a size for engagement with the reel strip.

5. A reel assembly as claimed in claim 4, wherein the ring recess comprises an annular ring recess.

6. A reel assembly as claimed in claim 4, wherein the ring member comprises a plurality of ring recesses disposed in a generally annular configuration and the reel strip comprises a plurality of reel strip tabs, each reel strip tab being receivable in and engageable with a ring recess.

7. A reel assembly as claimed in claim 4, wherein the reel drum comprises a second ring member, the second ring member being provided with at least one first ring recess for receiving and thereby engaging with the reel strip.

8. A reel assembly as claimed in claim 4, wherein the reel strip and the ring recess are configured to form an interference fit.

9. A reel assembly as claimed in claim 4, wherein the reel drum further comprises an adhesive disposed between the reel strip and the ring member for securing the reel strip relative to the ring member.

* * * * *